US011674306B2

(12) United States Patent
Immordino et al.

(10) Patent No.: US 11,674,306 B2
(45) Date of Patent: Jun. 13, 2023

(54) SMART DYNAMIC ACOUSTIC CEILING PANEL

(71) Applicant: USG INTERIORS, LLC, Chicago, IL (US)

(72) Inventors: Salvatore Immordino, Trevor, WI (US); Terry Rosenstiel, Vernon Hills, IL (US); Mark Joseph, Chicago, IL (US); Erik Luhtala, Los Angeles, CA (US); Andrew Schmidt, Evanston, IL (US); Kumar Natesaiyer, Grayslake, IL (US)

(73) Assignee: USG INTERIORS, LLC, Chicago, IL (US)

( * ) Notice: Subject to any disclaimer, the term of this patent is extended or adjusted under 35 U.S.C. 154(b) by 516 days.

(21) Appl. No.: 16/788,607

(22) Filed: Feb. 12, 2020

(65) Prior Publication Data

US 2020/0370292 A1 Nov. 26, 2020

Related U.S. Application Data

(60) Provisional application No. 62/852,672, filed on May 24, 2019.

(51) Int. Cl.

| | |
|---|---|
| ***E04B 1/82*** | (2006.01) |
| ***E04B 9/00*** | (2006.01) |
| *E04B 1/84* | (2006.01) |

(52) U.S. Cl.

CPC ..... *E04B 1/8209* (2013.01); *E04B 9/001* (2013.01); *E04B 9/003* (2013.01); *E04B 9/005* (2013.01);

(Continued)

(58) Field of Classification Search

CPC . E04B 1/74; E04B 1/82; E04B 1/8404; E04B 1/8209; E04B 2001/8457;

(Continued)

(56) References Cited

U.S. PATENT DOCUMENTS 2,698,071 A * 12/1954 Lee ..... E04B 9/003 49/193

3,411,605 A 11/1968 Coffman et al.

(Continued)

FOREIGN PATENT DOCUMENTS

DE 202020101867 U1 * 8/2021
WO WO-2016/014759 A1 1/2016

OTHER PUBLICATIONS

International Application No. PCT/US2020/033514, International Search Report and Written Opinion, dated Aug. 31, 2020.

*Primary Examiner* — Ryan D Kwiecinski

(74) *Attorney, Agent, or Firm* — Marshall, Gerstein & Borun LLP

(57) ABSTRACT

A dynamic acoustic system for use in connection with an indoor environment includes a plurality of elongated acoustic bars and a controller operably to each of the elongated acoustic bars. Each of the bars is operably coupled to a ceiling member of the indoor environment and includes an upper portion, a lower portion, a plurality of side surfaces extending between the upper and lower portions, an interior region at least partially defined by the upper portion, the lower portion, and the plurality of side surfaces, and at least one movable element movable between first and second positions. The controller selectively controls operation of the at least one movable element of a desired number of the plurality of elongated acoustic bars to alter an environmental characteristic of the indoor environment.

16 Claims, 11 Drawing Sheets

(52) U.S. Cl.
CPC ..... *E04B 2001/8414* (2013.01); *E04B 2001/8438* (2013.01)

(58) Field of Classification Search
CPC ..... E04B 2001/8476; E04B 2001/848; E04B 2001/849; E04B 2001/8414; E04B 2001/8438; E04B 9/001; E04B 9/003; E04B 9/005
See application file for complete search history.

(56) References Cited

U.S. PATENT DOCUMENTS

| | | | | |
|---|---|---|---|---|
| 3,590,354 | A * | 6/1971 | Shiflet | E04B 1/994 318/245 |
| 9,322,165 | B2 | 4/2016 | Luhtala | |
| 9,499,977 | B2 * | 11/2016 | Strand | G10K 11/16 |
| 9,932,736 | B2 * | 4/2018 | Ryan | G10K 11/16 |
| 10,119,269 | B2 * | 11/2018 | Perdue | G10K 11/004 |
| D840,551 | S * | 2/2019 | Kilian | D25/138 |
| 10,359,163 | B1 * | 7/2019 | Hettwer | F21S 4/28 |
| 10,672,376 | B1 * | 6/2020 | Pickens | F21V 33/006 |
| 10,728,653 | B2 * | 7/2020 | Graham | H04R 29/005 |
| 10,760,265 | B2 * | 9/2020 | Perdue | E06B 3/48 |
| 10,808,402 | B2 * | 10/2020 | Adams | E04B 9/001 |
| 10,961,700 | B2 * | 3/2021 | Udagawa | E04B 1/86 |
| 11,142,914 | B1 * | 10/2021 | Paulin | E04B 1/86 |
| 11,211,040 | B2 * | 12/2021 | Czech | F21S 8/043 |
| 2019/0292774 | A1 * | 9/2019 | Durali | E04B 1/994 |
| 2021/0131095 | A1 * | 5/2021 | Adelmann-Larsen | E04B 1/86 |

* cited by examiner

SMART DYNAMIC ACOUSTIC CEILING PANEL

CROSS-REFERENCE TO RELATED APPLICATIONS

This Application claims the benefit of U.S. Provisional Application No. 62/852,672 filed on May 24, 2019. The entire contents of which is hereby incorporated herein by reference.

FIELD OF THE DISCLOSURE

The present disclosure generally relates to acoustic ceiling panels for selectively adjusting acoustic characteristics of an environment.

BACKGROUND

Indoor or interior environments are used to accommodate a varying number of occupants over the course of the day. For example, a restaurant may see an increased number of patrons during an evening period as opposed to a lunchtime period. Similarly, a conference hall or meeting center may accommodate different numbers of patrons depending on the type of event being held. This increased number of patrons may in turn result in an increased overall noise level within the indoor environment, which may be unpleasant to some individuals.

While some environments incorporate sound absorptive panels or sheets, interior design preferences are trending towards a simple, more utilitarian appearance where exposed structural elements are visible. Accordingly, the use of these panels or sheets may be aesthetically undesirable. Further, such units may preclude the incorporation of sprinkler systems and/or other safety features in the environment. Additionally, while some acoustic treatment devices may be adjustable in nature, these devices lack precise control.

SUMMARY

In accordance with one embodiment of the present disclosure, a dynamic acoustic system for use in connection with an indoor environment includes a plurality of elongated acoustic bars and a controller operably to each of the elongated acoustic bars. Each of the bars is operably coupled to a ceiling member of the indoor environment and includes an upper portion, a lower portion, a plurality of side surfaces extending between the upper and lower portions, an interior region at least partially defined by the upper portion, the lower portion, and the plurality of side surfaces, and at least one movable element movable between first and second positions. The controller selectively controls operation of the at least one movable element of a desired number of the plurality of elongated acoustic bars to alter an environmental characteristic of the indoor environment.

In some approaches, the system may further include a sensor coupled to the controller that measures an environmental characteristic of the indoor environment. The sensor may be in the form of a microphone or a vibration sensor.

In some examples, the system may additionally include a sound absorbing material at least partially disposed within the interior region of the elongated acoustic bars. In any of these examples, the system may additionally include at least one sound generating device that is positioned at or near the acoustic bars. The at least one sound generating device is operably coupled to the controller in a manner that allows the controller to selectively control operation thereof.

In some forms, the at least one movable element is in the form of a plurality of louvres. In these examples, the controller is adapted to transmit a signal that selectively causes a number of the louvres to move. In some examples, the plurality of louvres are disposed on at least one of the plurality of side surfaces.

In other forms, the at least one movable element is in the form of a movable base member that is adapted to lower from the lower portion of the bar.

In accordance with another aspect of the present disclosure, a dynamic acoustic accessory for use in connection with an indoor environment includes an elongated shell, at least one mounting structure operably coupled to the elongated shell, and a movable base member. The elongated shell includes an upper portion, a lower portion a plurality of side surfaces extending therebetween, and an interior region at least partially defined by the upper portion, the lower portion, and the plurality of side surfaces. The mounting structure is adapted to secure the elongated shell to a ceiling surface of the indoor environment. The movable base member is positioned at the lower portion of the elongated shell and is movable between a first position and a second position to selectively expose at least a portion of the interior region of the elongated shell to the indoor environment to alter an environmental characteristic of the indoor environment.

In accordance with another aspect of the present disclosure, a dynamic acoustic accessory for use in connection with an indoor environment includes an elongated shell, at least one mounting structure operably coupled to the elongated shell, and a plurality of movable louvres. The elongated shell includes an upper portion, a lower portion a plurality of side surfaces extending therebetween, and an interior region at least partially defined by the upper portion, the lower portion, and the plurality of side surfaces. The mounting structure is adapted to secure the elongated shell to a ceiling surface of the indoor environment. The plurality of movable louvres are coupled to at least one of the side surfaces of the shell. Each of the movable louvres is movable between a first position and a second position to selectively expose at least a portion of the interior region of the elongated shell to the indoor environment to alter an environmental characteristic of the indoor environment.

BRIEF DESCRIPTION OF THE DRAWINGS

The above approaches are at least partially met through provision of the smart dynamic acoustic ceiling panel described in the following detailed description, particularly when studied in conjunction with the drawings, wherein.

Figure 1:
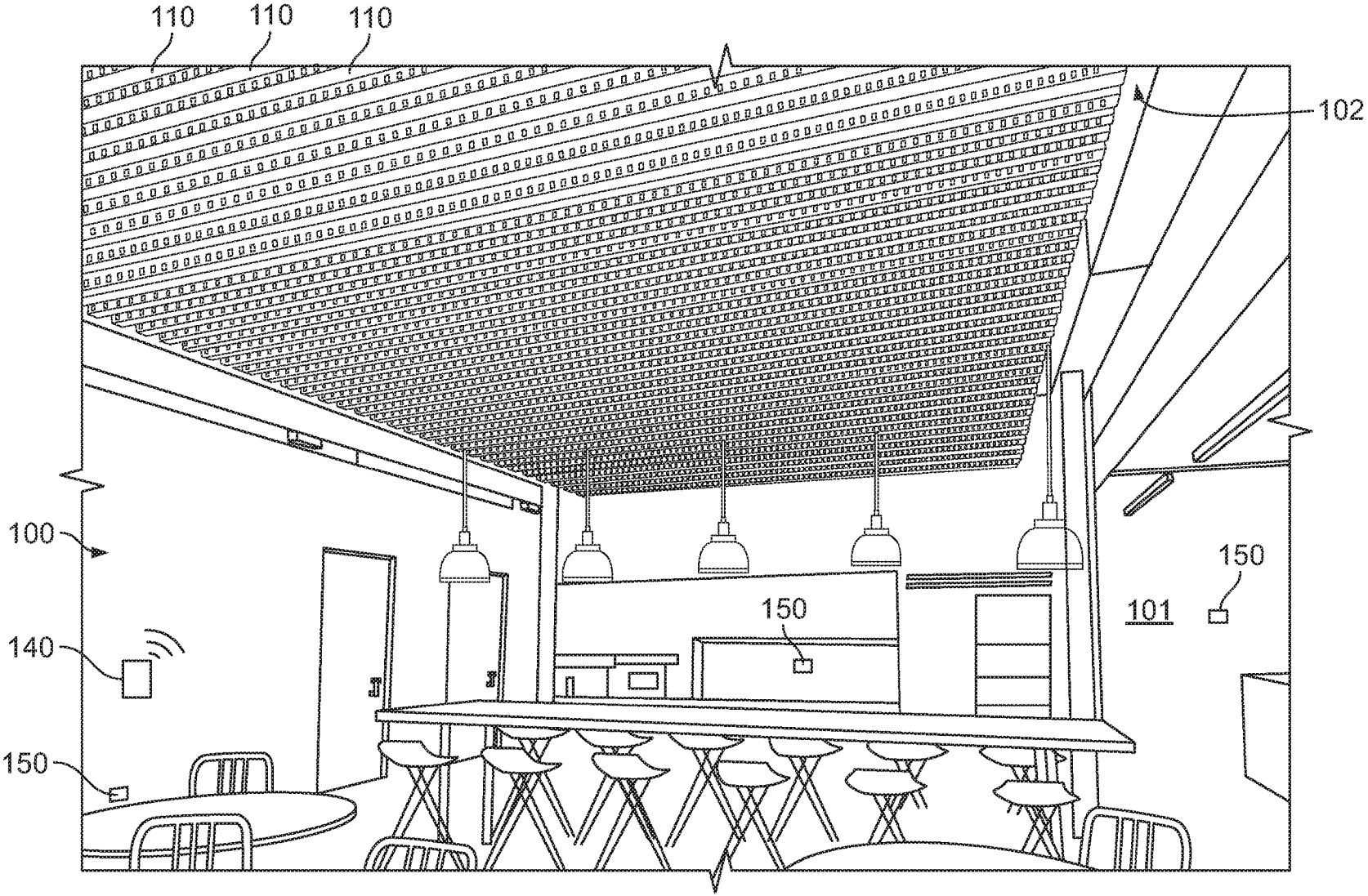
FIG. 1 illustrates a perspective view of an example indoor environment having a dynamic acoustic system in a first configuration in accordance with various embodiments of the present disclosure.
Figure 2A:
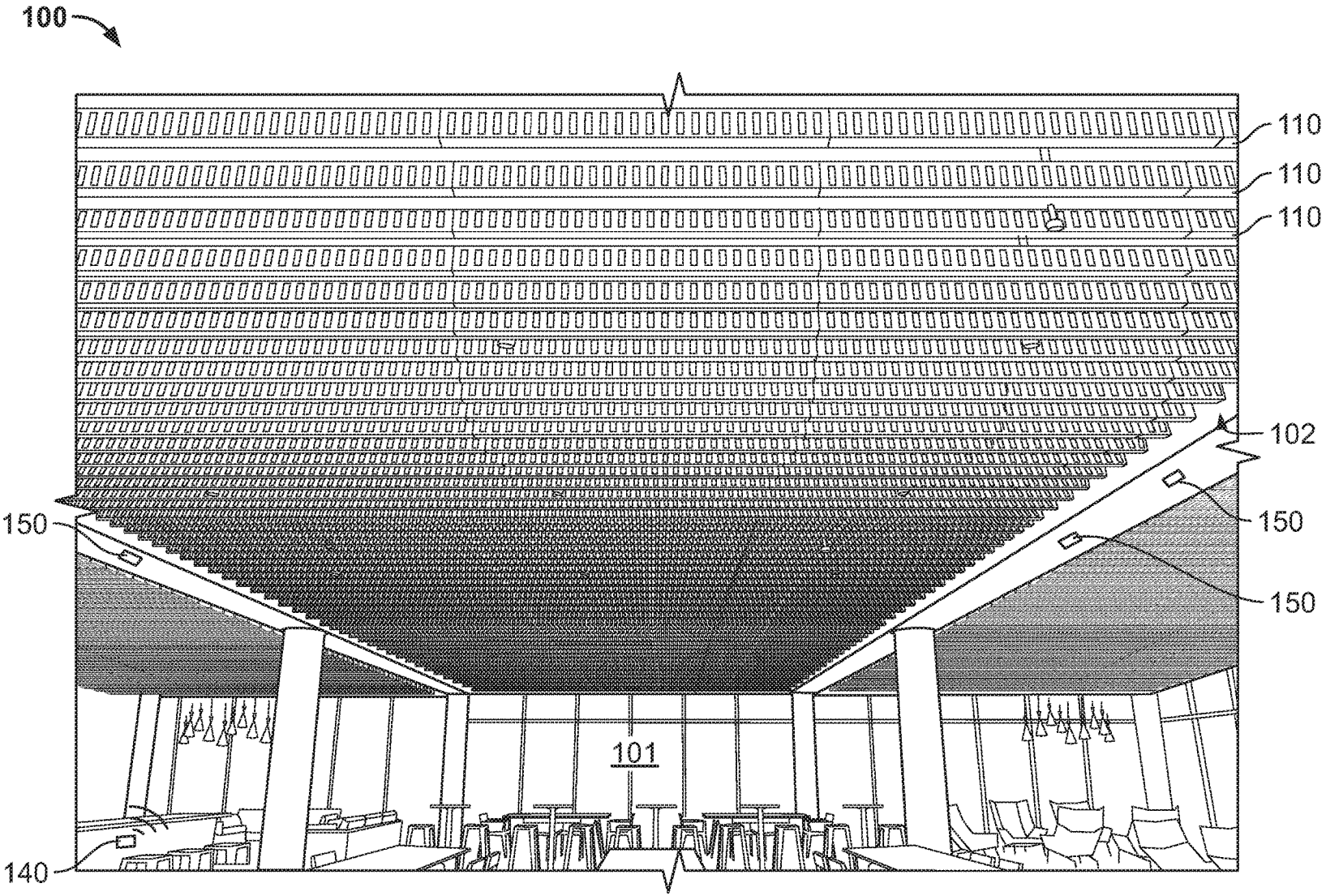
FIG. 2*a* illustrates a perspective view of an example indoor environment having a dynamic acoustic system in a first configuration in accordance with various embodiments of the present disclosure.
Figure 2B:
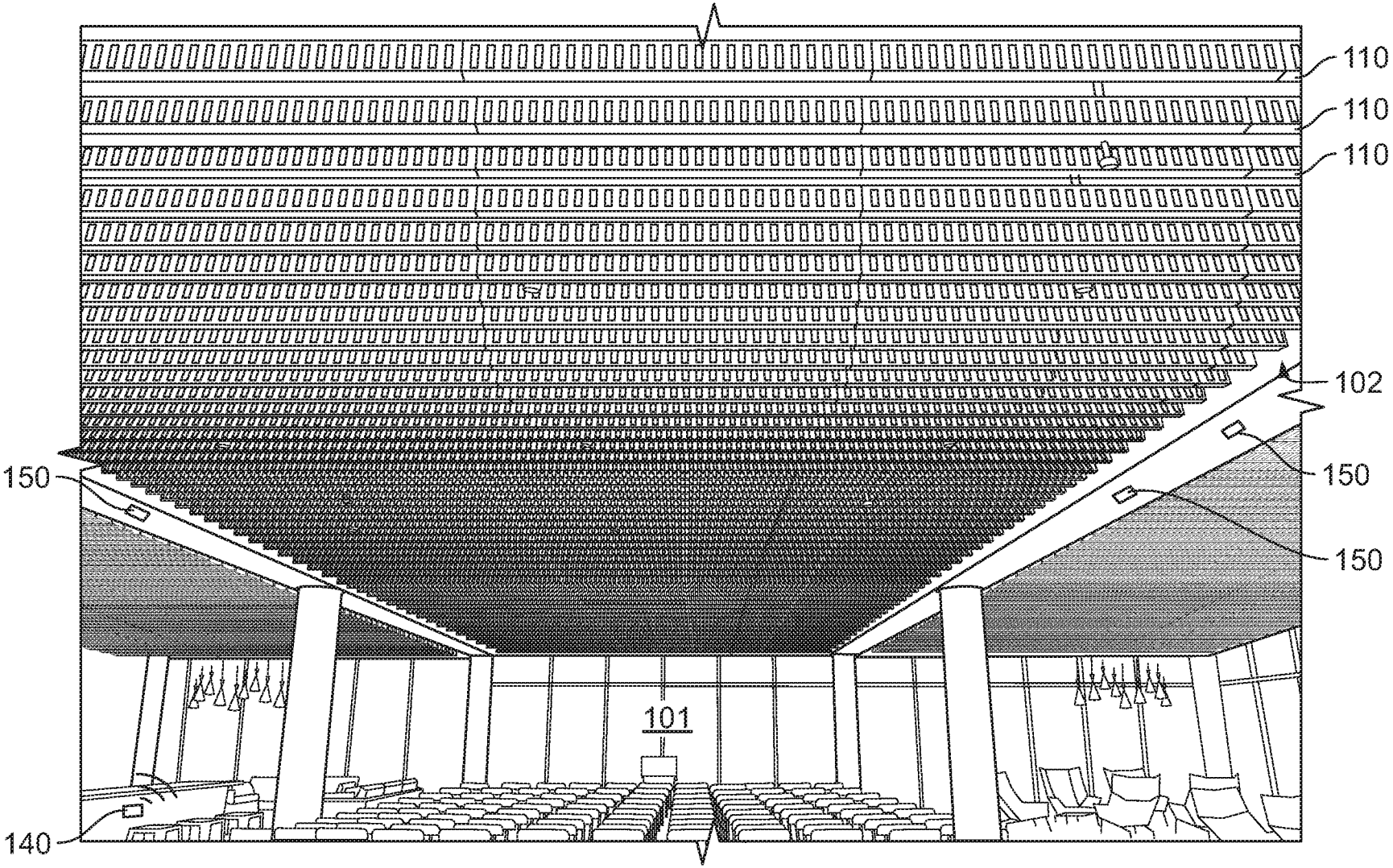
FIG. 2*b* illustrates a perspective view of the example indoor environment of FIG. 2*a* having the dynamic acoustic system in a second configuration in accordance with various embodiments of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, a dynamic acoustic ceiling system includes panelized ceiling elements equipped with components that can alter intrinsic acoustic characteristics of the indoor environment. Each panel includes active, operable, mechanical elements to conceal or expose, to varying degrees, an interior region that, in some examples, includes sound-absorbing materials. Such sound-absorbing materials may be passive or active sound absorbers. Each panel may additionally include embedded transducers (e.g., loudspeakers) to provide active, adjustable sound masking or voice reinforcement. All active and adjustable elements of each panel may be controlled by a programmable digital sound processor ("DSP") that receives an input by one or more integrated sensors (e.g., microphones). When multiple panels are combined as a system, they may communicate with each other via a unified digital control system to create a programmable, self-adjusting acoustic environment.

Referring now to the drawings, a dynamic acoustic system 100 is provided for use in connection with an indoor environment 101 having a ceiling member 102. The system 100 includes any number of elongated acoustic bars 110, a controller 140 operably coupled to each of the acoustic bars 110, and at least one sensor 150 operably coupled to the controller 140. The acoustic bars 110 can be provided in a number of forms that include any or all of the following subcomponents. The acoustic bars 110 are in the form of a shell 111 having an upper portion 111*a*, a lower portion 111*b*, and a number of side surfaces 112 extending therebetween. The side surfaces 112 have any number of openings 112*a*. As illustrated in FIGS. 1-8, the acoustic bars 110 have a generally rectangular prismatic shape, though other shapes and configurations are possible. The shell 111 of the acoustic bars 110 define a generally hollow interior region 114 (FIG. 3*b*) therein. Accordingly, the openings 112*a* formed on the side surfaces 112 create a sound pathway between the environment 101 and the interior region 114 of the shell 111.

The acoustic bars 110 may be mounted to the ceiling member 102 via any number of suitable mounting structures 115. For example, the acoustic bars 110 may be directly adhered to the ceiling 102 via adhesives, fasteners such as bolts and/or brackets, and the like. Other examples of suitable mounting approaches will be discussed in further detail below.

Each of the acoustic bars 110 includes at least one movable element that selectively creates a pathway for sound waves to enter into the interior region 114 from the environment 101. As illustrated in FIGS. 2*a*-3*b*, the movable element is in the form of a movable louvre 116 or baffle positioned along any number of side surfaces 112 of the shell 111. The movable louvre 116 is in the form of a generally flat panel having a rectangular shape extending along a longitudinal axis "L", though any desired shape or configuration may be used.

In some examples, the movable louvre 116 is rotatably coupled to the shell 111 via a pin 118 or other hinged mounting member. The movable louvre 116 may define a mounting orifice (not illustrated) through which the pin 118 is inserted to secure the movable louvre 116 to the shell 111. In some approaches, the mounting mechanism may include a spring or other resilient member that maintains the movable louvre 116 in a normally-closed position. A drive mechanism 120 may be coupled to each movable louvre 116 that causes the movable louvre 116 to move. In some examples, the system 100 may use one drive mechanism 120 for each movable louvre 116 to allow for fine-turning a number of open sound pathways. In other examples, however, one drive mechanism 120 may be operably coupled to a number of movable louvres 116 to control their operation. In yet other examples, any number of drive mechanisms 120 may be used to drive any desired number of movable louvres 116. Further, in some examples, the drive mechanism 120 may be releasably coupled to each movable louvre 116 such that the drive mechanism 120 may selectively exert a driving force on a desired movable louvre 116 when desired. One such example of a releasable coupling system is a cam system; though other examples are possible.

The drive mechanism 120 may be in the form of a motor, a servo-motor, a solenoid or other actuator, a geared mechanism, a pulley mechanism, and the like. Other examples are possible. The drive mechanism 120 may be uni-directional—meaning it exerts an urging force on the movable louvre 116 a single direction, or alternatively may be multi-directional—meaning it exerts an urging force on the movable louvre 116 in multiple directions.

Figure 3A:
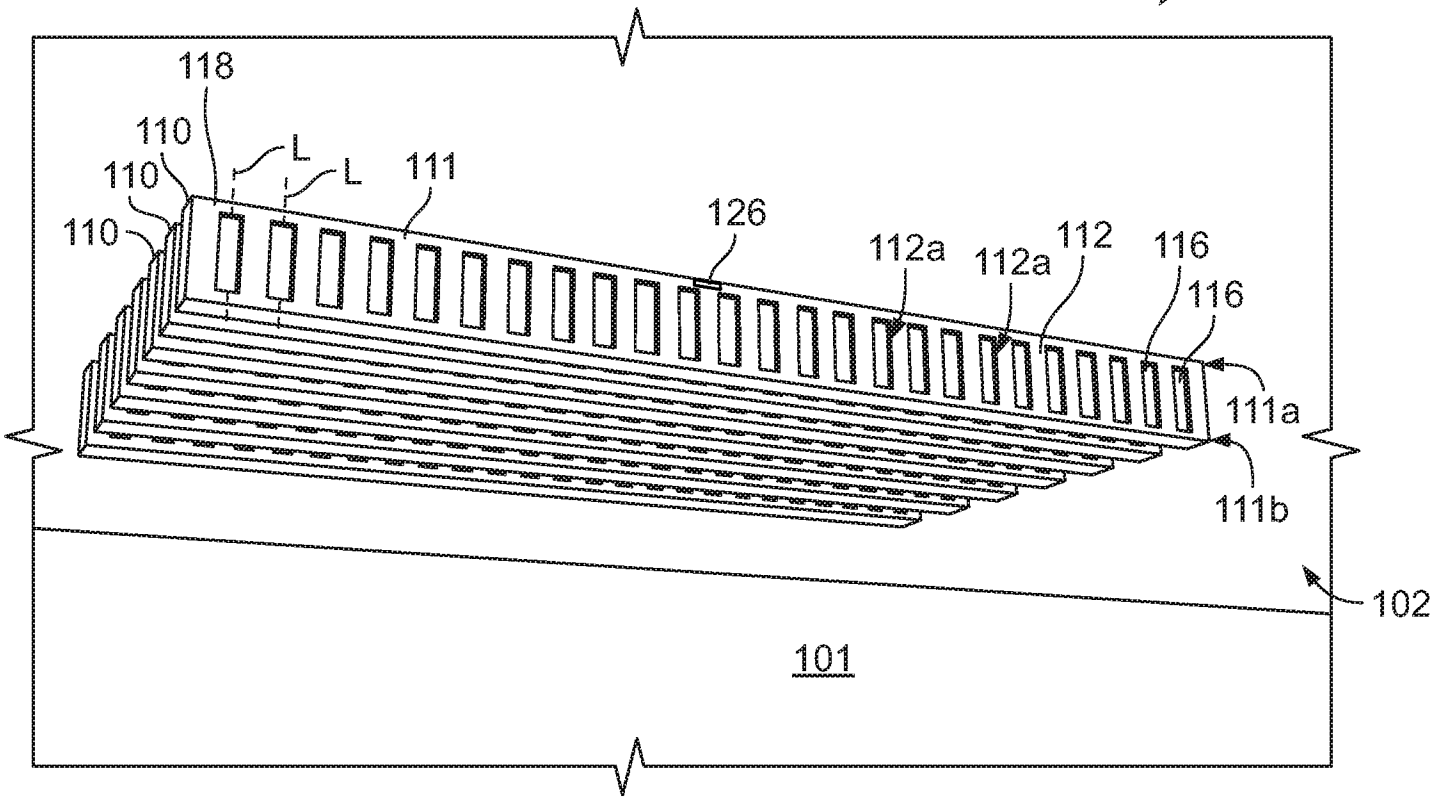
FIG. 3*a* illustrates a perspective view of a first example dynamic acoustic accessory of the example dynamic acoustic system of FIGS. 1-2*b* in a closed configuration in accordance with various embodiments of the present disclosure.
Figure 3B:
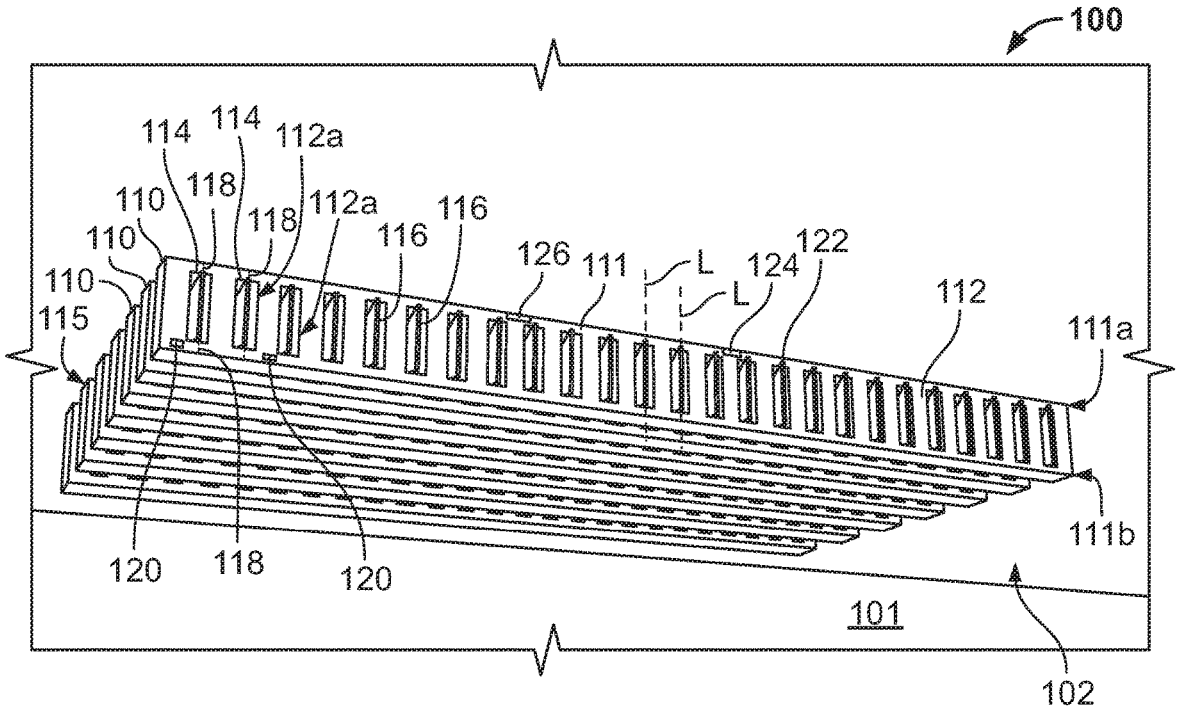
FIG. 3*b* illustrates a perspective view of the example dynamic acoustic accessory of the example dynamic acoustic system of FIGS. 1-3*a* in an open configuration in accordance with various embodiments of the present disclosure.

As illustrated in FIG. 3*b*, in some examples, the pin 118 is positioned along the longitudinal axis L of the movable louvre 116 such that the movable louvre 116 is rotatable about the longitudinal axis L. In these examples, the movable louvre is rotatable between a first fully closed position (FIG. 3*a*) and a second fully open position (FIG. 3*b*). The movable louvre 116 may be positioned at any intermediate position between the closed and opened positions as desired to selectively alter a size of the opening into the interior region 114 of the shell 111. In other words, any number of movable louvres 116 may be selectively rotated to provide for varying openings which create the sound pathways between the environment 101 and the interior region 114 of the shell 111.

In some examples, the acoustic bars 110 may also include a sound-absorbing material 122 at least partially disposed within the interior region 114. When the interior region 114 of the acoustic bars 110 is exposed to the environment 101 and air-borne sound waves, based on the positioning of the movable louvres 116, the sound-absorbing material 122 will absorb the sound waves to reduce an overall decibel level of the environment 101. In some examples, the sound-absorbing material 122 are passive absorbers such as glass fibers and/or mineral fibers. In other examples, the sound-absorbing material 122 are active, adjustable absorbers such as acoustic metamaterials. Any combination of passive and/or active materials may be used.

In some examples, the acoustic bars 110 may additionally include at least one sound-generating device 124 coupled and/or disposed adjacent thereto. Specifically, in some examples, the sound-generating device 124 may be disposed at the upper portion 111*a* of the shell and may be pointed downwardly such that sound waves generated by the sound generating-device 124 are directed into the interior region 114 of the shell 111. The sound-generating device 124 may be an electroacoustic transducer that generates sound to provide adjustable sound masking and/or sound reinforcement, depending on the desired application. In some examples, the sound-generating device 124 is a loudspeaker, a cluster of loudspeakers, distributed mode loudspeakers, and/or focused loudspeaker arrays. Any number or combination of these sound-generating devices 124 may be positioned and/or disposed within the acoustic bars 110.

The acoustic bars 110 may further include a programmable controller such as a digital signal processor (DSP) 126 that controls the active acoustic elements (e.g., the movable louvres 116, the sound-absorbing material 122, and/or the sound-generating device 124. The DSP 126 may include a communication link 128 that communicates with the controller 140 in a manner described below.

Figure 11:
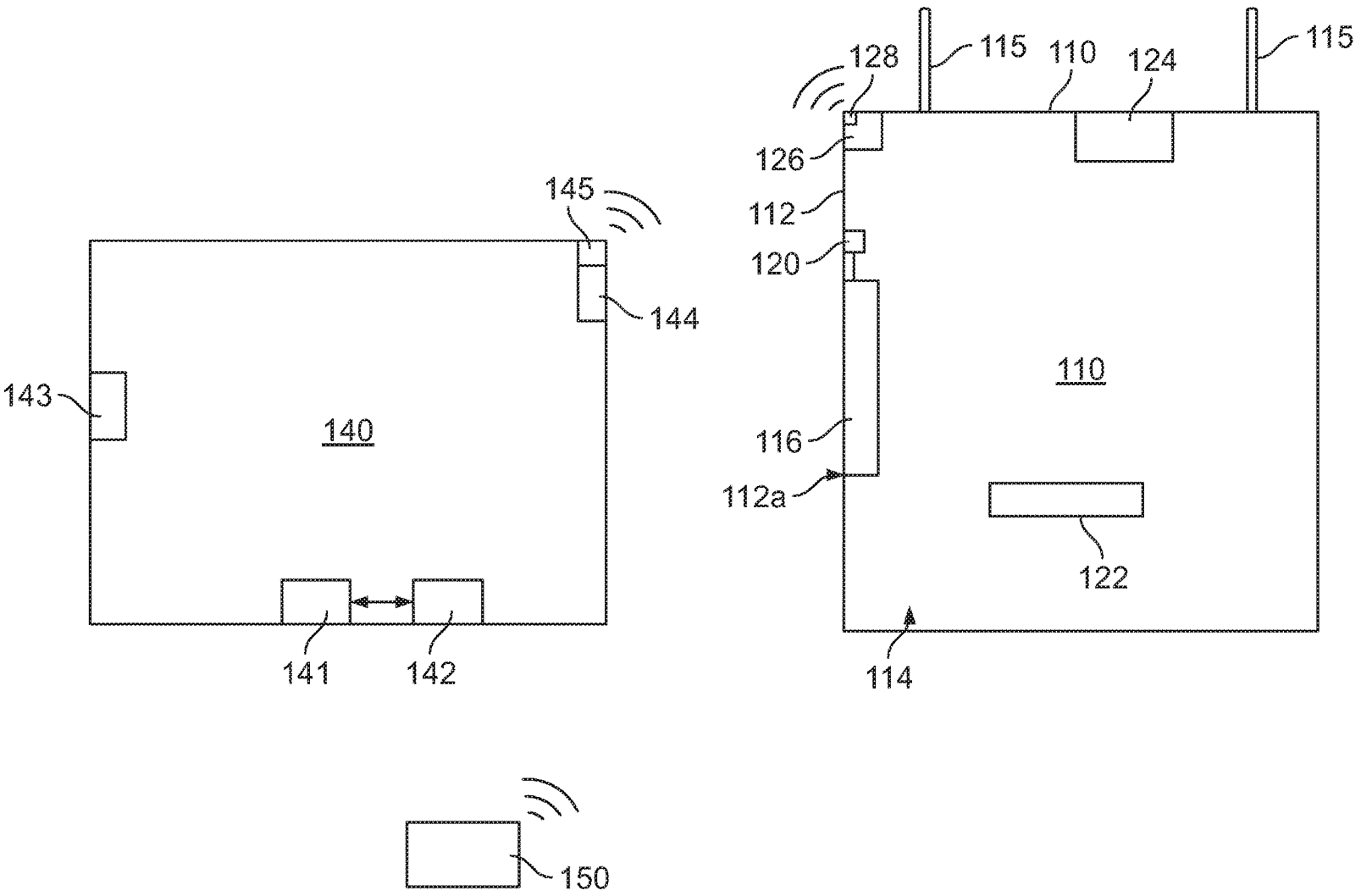
FIG. 11 illustrates a schematic of the dynamic acoustic system in accordance with various embodiments of the present disclosure.

Specifically, turning to FIG. 11, as previously noted, the dynamic acoustic system 100 includes a primary controller 140 that is communicatively coupled with each of the acoustic bars 110 via connection 145 that communicates with the communication link 128 of the DSP 126. In some examples, the controller 140 may not be communicatively coupled to each of the acoustic bars 110, rather, any number of acoustic bars 110 may be daisy-chained to each other such that one acoustic bar 110 may control the operation of several additional acoustic bars 110. The connection 145 may be any type of wired and/or wireless communications protocol adapted to transmit and/or receive electronic signals. In these examples, the controller 140 is in signal communication with at least one sensor, such as, for example, sensor 150 located in the environment 101 at any desired location. Any number of additional sensors capable of sensing any number of characteristics of the environment 101 and/or the acoustic bars 110 may be used and placed at desired locations.

The controller 140 can be disposed in a number of positions with respect to the environment 101. As examples, the controller 140 can be placed on a wall or in a discrete location. In some examples, the controller 140 may be integral with one of the acoustic bars 110, for example, the controller 140 may be contained in an enclosure that is mounted on one of the acoustic bars 110, contained in a separate enclosure that is positioned adjacent or proximate to one of the acoustic bars 110, or can be positioned remotely. In some embodiments, the controller 140 can partially or fully control functions of the acoustic bars 110 via wired and/or wired signal communications as known and/or commonly used in the art.

The sensor 150 may be any type of sensor adapted to measure (either directly or indirectly) one or more characteristics of the environment 101 and/or the acoustic bars 110. The sensor 150 may measure any environmental characteristic, such as, for example, a decibel level, a vibration level, a number of people in the environment, illumination levels, motion (e.g., via a Pyroelectric ("Passive") InfraRed Sensors), temperatures, humidity, air flow, air particulates, gases such as carbon monoxide, air pressure, and/or electromagnetic disturbances, or any one or more of any number of additional characteristics which are indicative of these. Further still, sound (sonar) waves, radio waves, light waves (LIDAR), and computer vision may also be used to map and/or identify physical objects and/or people within the environment 101.

As an example, the sensor 150 may be a microphone or array of microphones, though other examples are possible. When microphones are implemented, systems may be used to identify individual people using voice-recognition algorithms that identify unique voices. Such a system can be used in conjunction with speakers to generate a level sound volume throughout the environment 101 and/or to enhance the sound of human speech. Further, such a system may act as an intercom system, may be capable of responding to voice commands, and/or detect equipment failures.

The sensor 150 generates a signal which is transmitted to an input of the controller 140. In some examples, the controller 140 can be set, configured, and/or programmed with logic, commands, and/or executable program instructions to provide appropriate correction factors to estimate or calculate values for the measured characteristic in the environment 101.

In some embodiments, the controller 140 generates a signal which is transmitted from an output of the controller 140 to the DSP 126. The controller 140 can control any number of characteristics of the acoustic bars 110, such as, for example, activation of any combination of drive mechanisms 120, any active sound-absorbing materials 122, and/or any combination of sound-generating devices 124.

The signal or signals from the controller 140 may be used to control operation of the system 100 such that variations in environmental characteristics influencing decibel levels are taken into account by the controller 140. Adjustments may be made by the controller 140 in real time or in near-real time (that is, with a minimal delay between sensors 150 sensing values and changes being made to the system 100), or corrections can be made with some delay. Furthermore, historical data may be used as a basis for making adjustments to the system 100. The controller 140 may be connected to the sensors 150 and the DSP 126 and/or any other components in the system 100 via any type of signal communication approach known in the art.

The controller 140 may also be a DSP that includes software 141 adapted to control its operation, any number of hardware elements 142 (such as, for example, a non-transitory memory module and/or processors), any number of inputs 143, any number of outputs 144, and any number of connections 145. The software 141 may be loaded directly onto a non-transitory memory module of the controller 140 in the form of a non-transitory computer readable medium, or may alternatively be located remotely from the controller 140 and be in communication with the controller 140 via any number of controlling approaches. The software 141 includes logic, commands, and/or executable program instructions which may contain logic and/or commands for controlling the acoustic bars 110 according to a desired operational program. The software 141 may or may not include an operating system, an operating environment, an application environment, and/or a user interface.

The hardware 142 uses the inputs 143 to receive signals, data, and information from the components being controlled by the controller 140. The hardware 142 uses the outputs 144 to send signals, data, and/or other information to the acoustic bars 110. The connection 145 represents a pathway through which signals, data, and information can be transmitted between the controller 140 and the acoustic bars 110. In various embodiments this pathway may be a physical connection or a non-physical communication link that works analogous to a physical connection, direct or indirect, configured in any way described herein or known in the art. In various embodiments, the controller 140 can be configured in any additional or alternate way known in the art.

The connection 145 represents a pathway through which signals, data, and information can be transmitted between the controller 140 and the injection molding machine 100. In various embodiments, these pathways may be physical connections or non-physical communication links that work analogously to either direct or indirect physical connections configured in any way described herein or known in the art. In various embodiments, the controller 140 can be configured in any additional or alternate way known in the art.

In operation, the sensor 150 measures the environmental characteristic (e.g., airborne sound in the vicinity of the system 100). Based on user settings of the controller 140 and the incoming signals from the sensors 150, the controller 140 transmits signals to the outputs 144 that enables the adjustment of a particular number of acoustic bars 110 to enable the acoustic bars 110 to change its acoustic properties. The system 100 allows for high levels of granularity—for example, the controller 140 may only need to move a single movable louvre 116 on a single acoustic bar 110 to adjust the environmental characteristic to a desired level. Conversely, the controller 140 may move any number of movable louvres 116 on any number of acoustic bars 110 to adjust the environmental characteristic to a desired level. When multiple acoustic bars 110 are used in the system 100, they may communicate with each other via a unified digital control system to create a programmable, self-adjusting dynamic acoustic environment.

In some examples, a routine may be implemented on the controller 140 that may or may not rely on sensed measurements. For example, the program may be time-based such that the active control elements of the acoustic bars 110 are activated and/or actuated at specific times (e.g., during busy periods within the environment 101).

Figure 4:
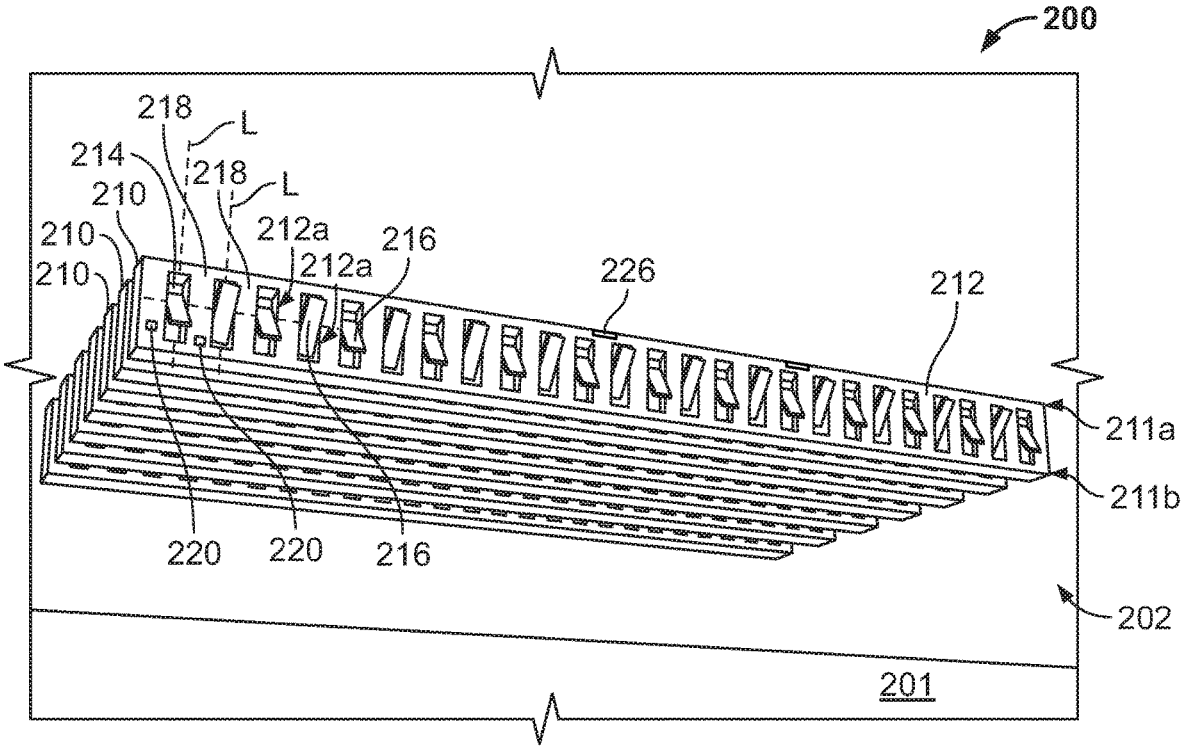
FIG. 4 illustrates a perspective view of a second alternative example dynamic acoustic accessory in an open configuration in accordance with various embodiments of the present disclosure.

Turning to FIG. 4, a system 200 having an alternative acoustic bar 210 design is provided that includes similar features as the acoustic bar 110 described in FIGS. 3*a* and 3*b*, and thus will not be described in substantial detail. However, in this illustrated example, the movable louvres 216 are rotatably mounted to the sidewalls 212 in a transverse direction relative to the longitudinal axis L. As a result, the movable louvres 216 rotate outwardly from the shell 211, which may provide for more increased reflection of sound waves (compared to the example configuration illustrated in FIG. 3*b* where sound waves are less restricted from entering the interior region 114 of the shell 111 when the movable louvres 116 are in the open position). As before, any number of movable louvres 216 may be coupled to any number of drive mechanisms 220 to allow for individual control of the movable louvres 216 if desired.

Figure 5:
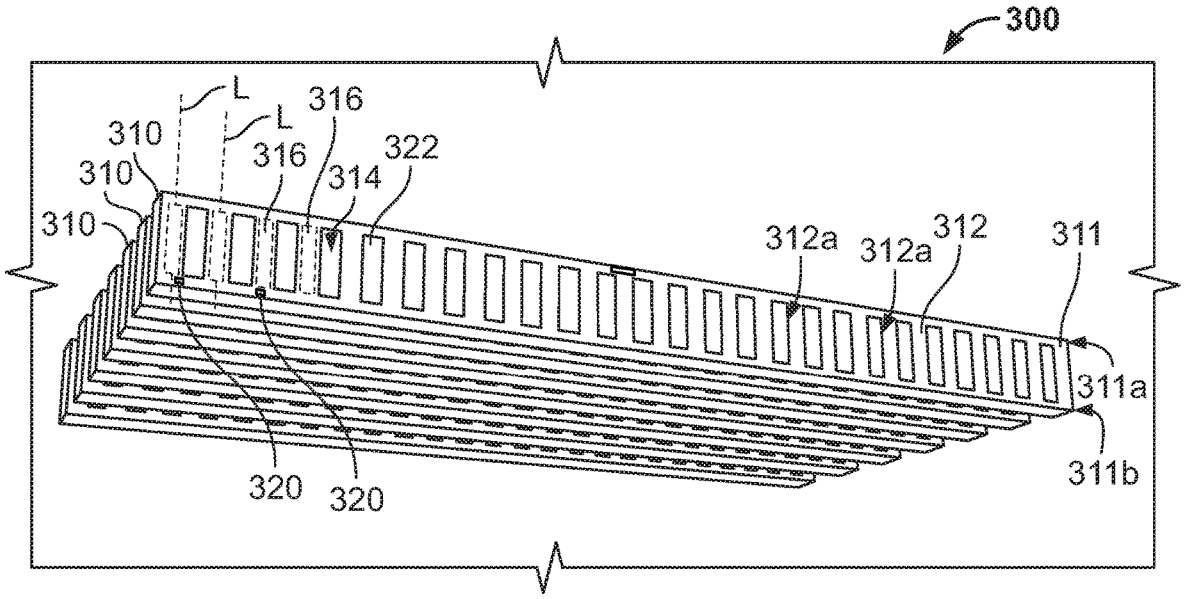
FIG. 5 illustrates a perspective view of a third alternative example dynamic acoustic accessory in an open configuration in accordance with various embodiments of the present disclosure.

Turning to FIG. 5, a system 300 having an alternative acoustic bar 310 design is provided that includes similar features as the acoustic bars 110, 210 described in FIGS. 3*a*-4, and thus will not be described in substantial detail. However, in this illustrated example, the movable louvres 316 are slidably mounted to the sidewalls 312. In other words, in these examples, the movable louvres 316 may slide relative to the openings 312*a* formed on the sidewalls 312 via any number of arrangements such as tracks, channels, and the like. As before, any number of movable louvres 316 may be coupled to any number of drive mechanisms 320 to allow for individual control of the movable louvres 316 if desired. The movable louvres 316 may be single or multi-layered as desired.

Turning to FIGS. 6*a*-8, a system 400 having an alternative acoustic bar 410 design is provided that includes similar features as the acoustic bars 110, 210, 310 described in FIGS. 3*a*-5, and thus will not be described in substantial detail. However, in this illustrated example, the movable element is in the form of a movable base member 416 operably coupled to the shell 411. In these examples, the movable base member 416 lowers from the lower portion 411*b* of the shell 411 to expose the interior region 414 (which may accommodate sound-absorbing material 422 and/or a sound generating device 424) thereof.

Figure 6C:
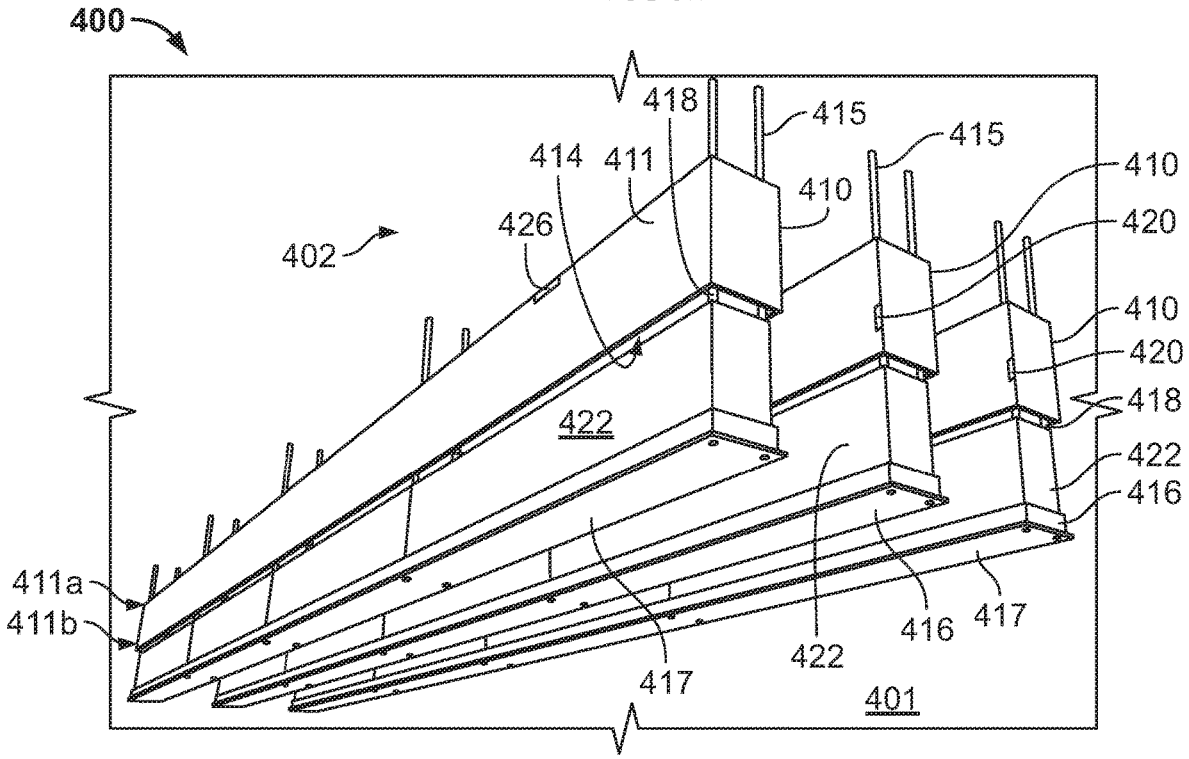
FIG. 6*c* illustrates a perspective view of the fourth alternative example dynamic acoustic accessory of FIGS. 6*a* and 6*b* in an open configuration in accordance with various embodiments of the present disclosure.
Figure 7:
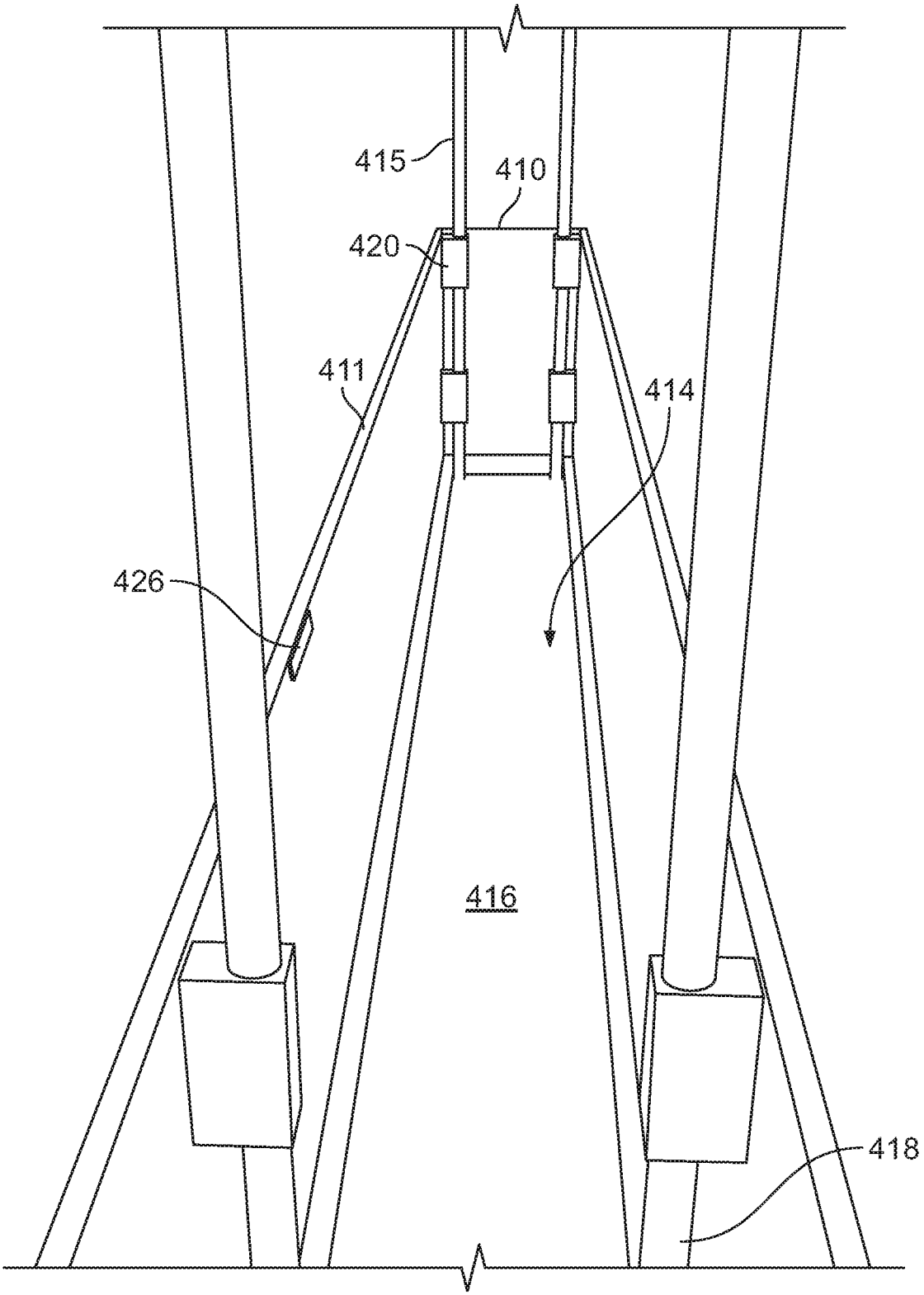
FIG. 7 illustrates an upper perspective view of the fourth alternative example dynamic acoustic accessory of FIGS. 6*a*-6*c* in accordance with various embodiments of the present disclosure.
Figure 8:
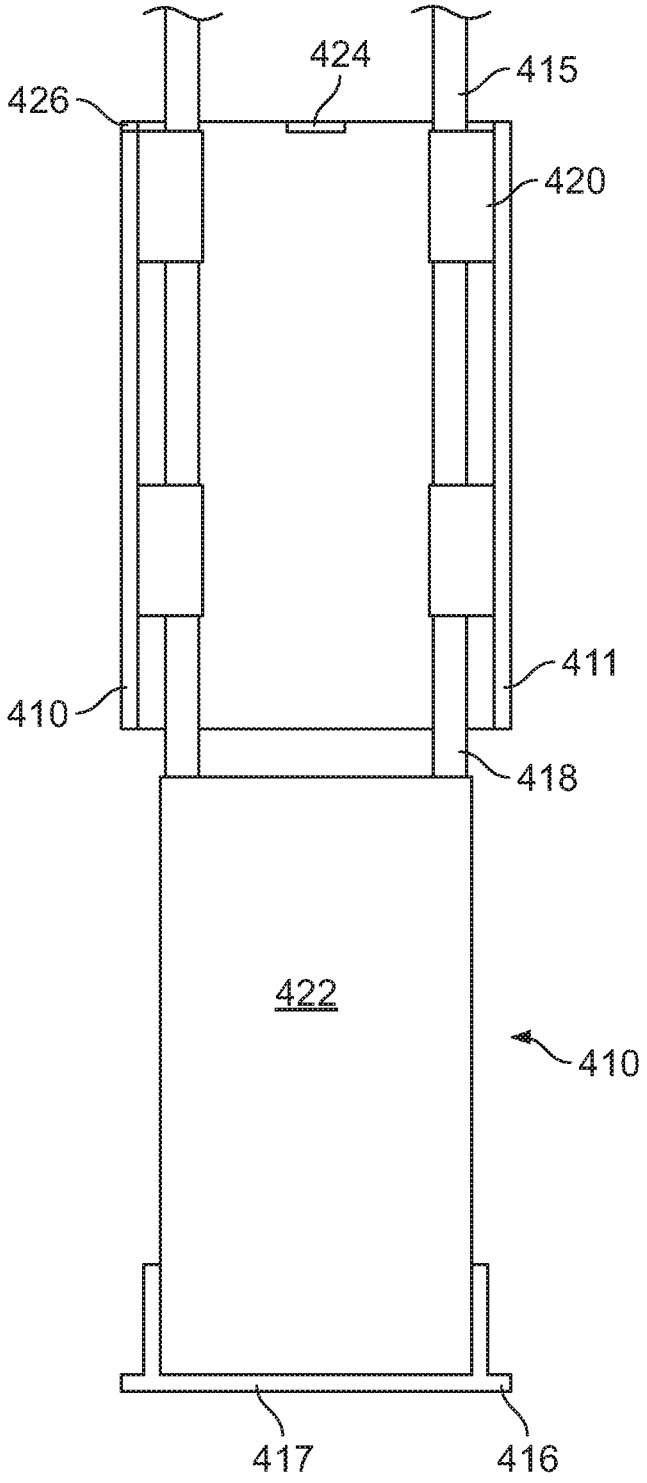
FIG. 8 illustrates a cross-sectional view of the fourth alternative example dynamic acoustic accessory of FIGS. 6*a*-7 in accordance with various embodiments of the present disclosure.

More specifically, the acoustic bar 410 is coupled to the ceiling member 402 via a mounting structure 415, which, in these examples may be a chain or rod member. The movable base member 416 is in the form of an elongated platform 417 extending all or a portion of the length of the acoustic bar 410. As illustrated in FIGS. 6*c* and 7, the movable base member 416 is secured to the shell 411 and/or the mounting structure 415 via a base support 418 that is driven by a drive mechanism 420. In some examples, the base support 418 may be in the form of a pulley system, a piston or other telescoping mechanism, and/or any other mechanism that generates axial movement. The drive mechanism 420 may be a solenoid actuator, a motor, a resilient member (e.g., a torsion spring, an axial spring, a watch spring, etc.) capable of urging the base support 418 downwardly. In examples where the mounting structure 415 is a rod member, a portion of the rod member 415 may form the base support 418 and/or the drive mechanism 420 that lowers the movable base member 416.

Figure 6A:
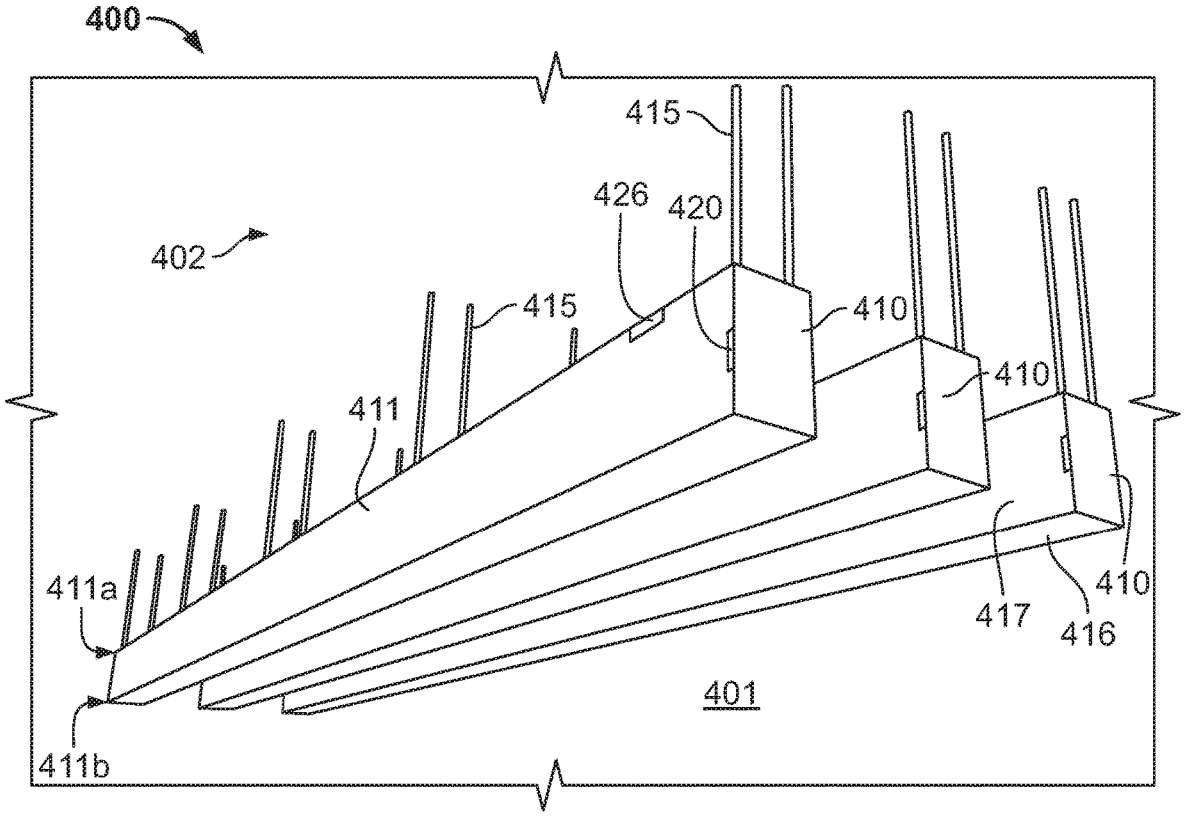
FIG. 6*a* illustrates a perspective view of a fourth alternative example dynamic acoustic accessory in a closed configuration in accordance with various embodiments of the present disclosure.
Figure 6B:
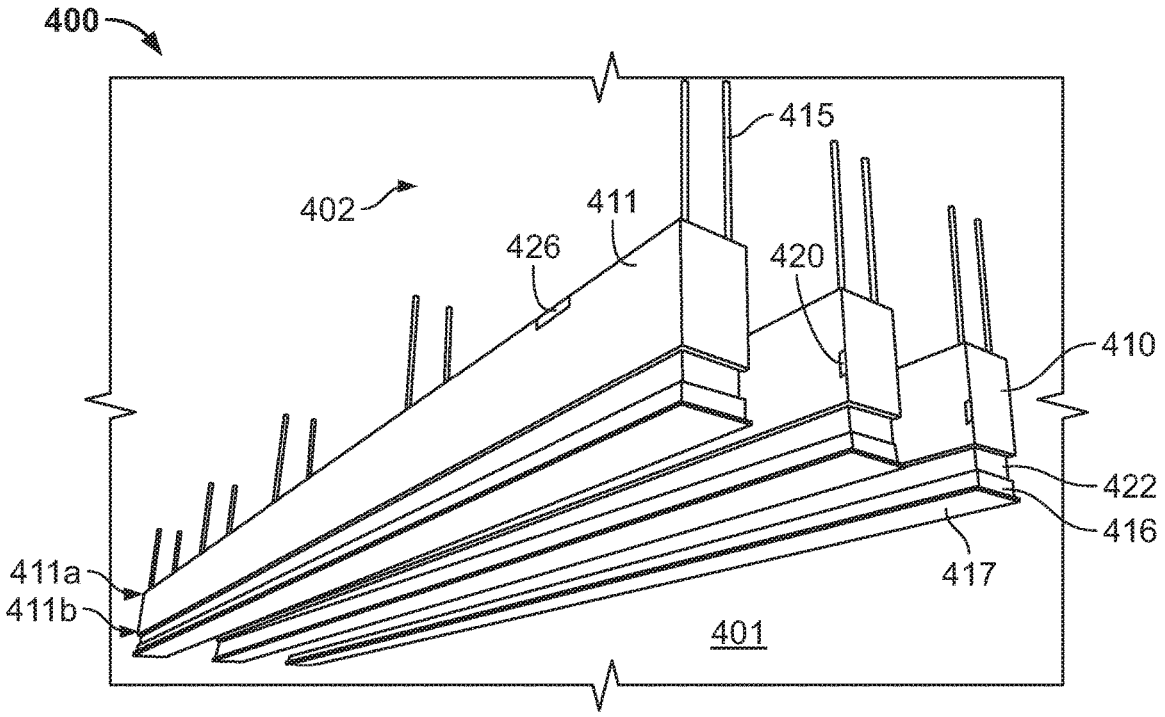
FIG. 6*b* illustrates a perspective view of the fourth alternative example dynamic acoustic accessory of FIG. 6*a* in a partially opened configuration in accordance with various embodiments of the present disclosure.

As illustrated in FIG. 6*b*, upon receiving an input from the controller 140, the DSP 426 activates the drive mechanism 420 to extend the movable base member 416 to a desired level relative to the lower portion 411*b* of the shell 411, thus exposing the interior region 414 of the shell 411. The extension of the movable base member 416 can be adjusted based on the desired environmental characteristic. As before, the controller 140 may further cause the DSP 426 to activate the sound absorbing material 422 (if so equipped) and/or the sound-generating device 424 (if so equipped).

Figure 9:
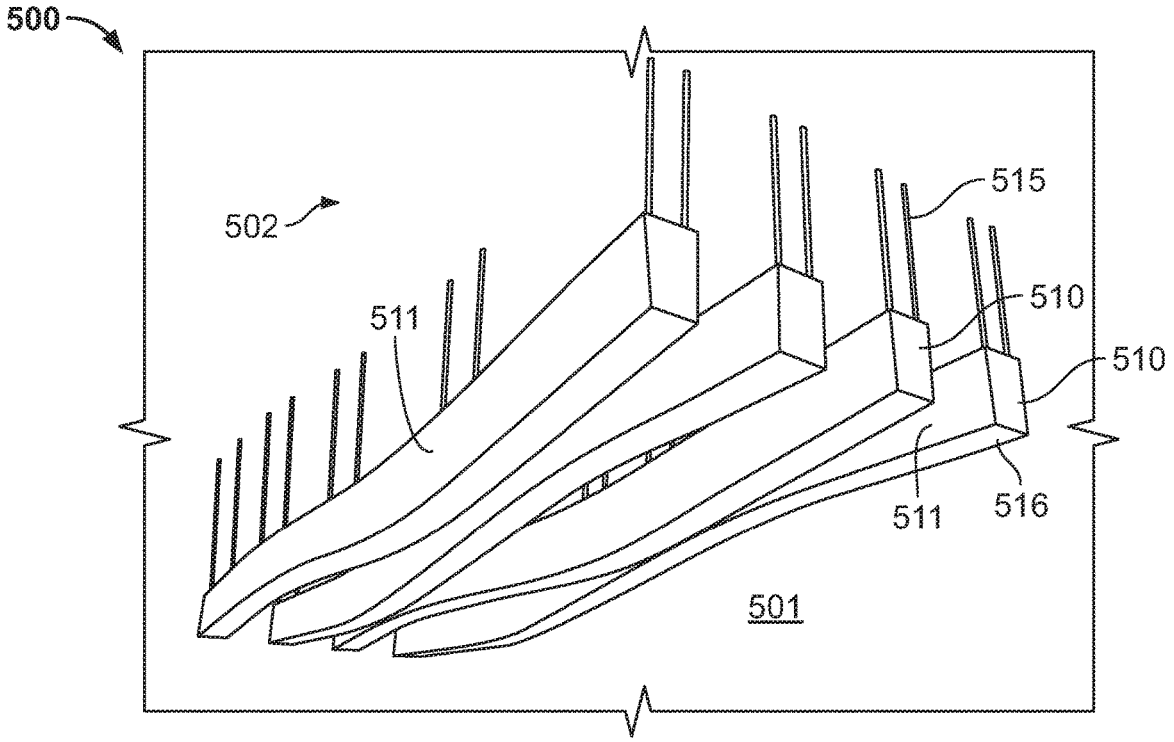
FIG. 9 illustrates a perspective view of a fifth alternative example dynamic acoustic accessory in accordance with various embodiments of the present disclosure.

Turning to FIG. 9, a system 500 having an alternative acoustic bar 510 design is provided that includes similar features as the acoustic bar 410 described in FIGS. 6*a*-8, and thus will not be described in substantial detail. However, in this illustrated example, the acoustic bar 510 is in the form of an elongated shell 511 having a wave-like or curved pattern.

Figure 10:
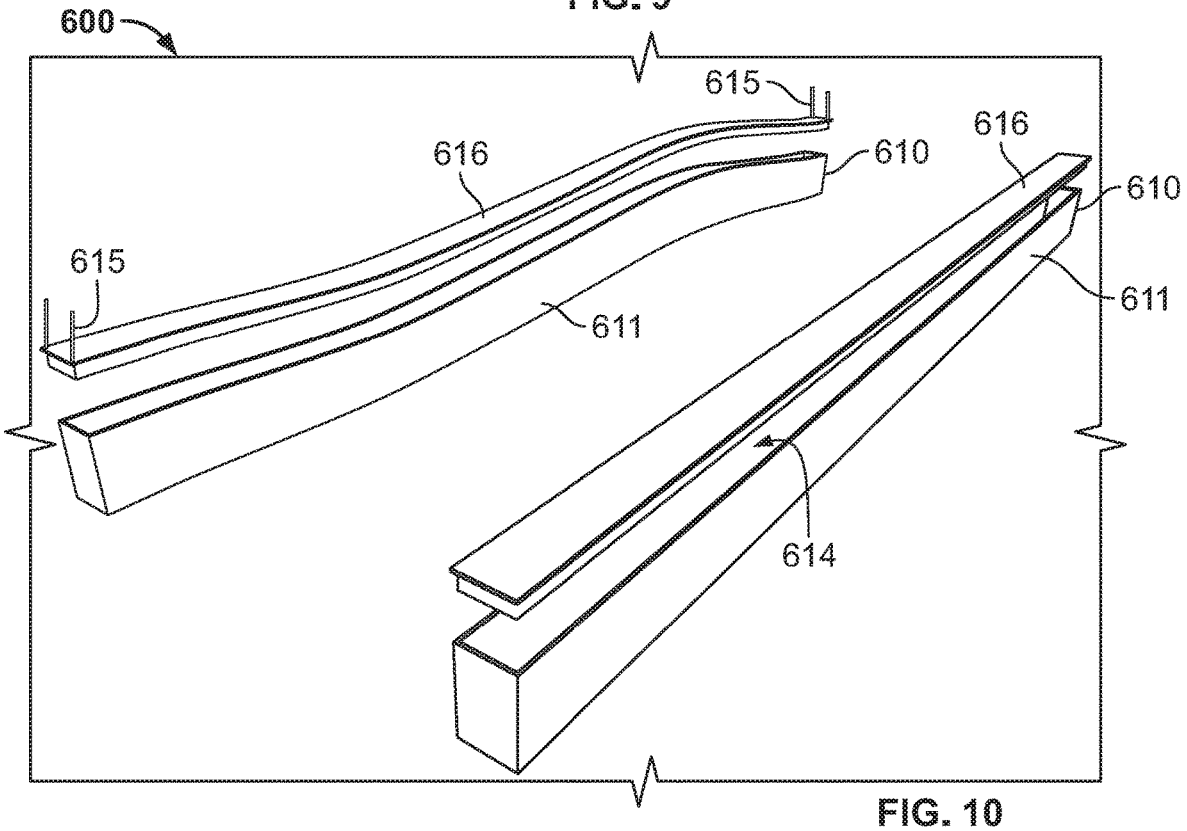
FIG. 10 illustrates a perspective view of a sixth alternative example dynamic acoustic accessory in accordance with various embodiments of the present disclosure.

Turning to FIG. 10, a system 600 having an alternative acoustic bar 610 design is provided that includes similar features as the acoustic bars 410, 510 described in FIGS. 6*a*-9, and thus will not be described in substantial detail. However, in this illustrated example, the components of the acoustic bar 610 are generally reversed in that the shell 611 is movable downwardly relative to an upper base member 616, which is mounted to the ceiling via any number of approaches.

In some examples, any desired combination of movable elements (e.g., movable louvres and/or movable base members) may be used that move relative to the shell in any of the described approaches. In other words, any number of movable louvres 116 may be rotatably coupled to the sidewalls 112 along the longitudinal axis L, any number of movable louvres 216 may be rotatably coupled to the sidewalls 2112 transversely to the longitudinal axis L, any number of movable louvres 316 may be slidably coupled to the sidewalls 312, and/or any number of movable base members 416 may be coupled to the shell 411 to extend therefrom as desired.

So configured, the system provides enhanced sound altering characteristics while covering a limited amount of ceiling surface. Such a system is tunable as desired to allow for an adjustable amount of reverb in certain situations (e.g., when the environment is less populated) and more absorptive in other situations (e.g., when the environment is more populated). Further, by incorporating speakers into each of the panels, additional speakers are no longer needed, thus reducing assembly steps and complexity of the panels.

Unless specified otherwise, any of the feature or characteristics of any one of the embodiments of the smart dynamic acoustic ceiling panels disclosed herein may be combined with the features or characteristics of any other embodiments of the smart dynamic acoustic ceiling panels.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

What is claimed is:

1. A dynamic acoustic system for use in connection with an indoor environment, the dynamic acoustic system comprising:

a plurality of elongated acoustic bars each being operably coupled to and positioned below a ceiling member of the indoor environment, each of the plurality of acoustic bars including:

an upper portion, a lower portion, a plurality of side surfaces extending between the upper portion and the lower portion, an interior region at least partially defined by the upper portion, the lower portion, and the plurality of side surfaces, and a plurality of movable elements each being movable between a first position and a second position;

a controller operably coupled to each of the plurality of elongated acoustic bars to selectively control operation of any desired number of the plurality of movable elements of any desired number of the plurality of elongated acoustic bars to alter an acoustic characteristic of the indoor environment.

2. The dynamic acoustic system of claim 1, further comprising a sensor coupled to controller, the sensor adapted to measure an acoustic characteristic of the indoor environment.

3. The dynamic acoustic system of claim 2, wherein the sensor comprises at least one of a microphone or a vibration sensor.

4. The dynamic acoustic system of claim 1, further comprising a sound absorbing material at least partially disposed within the interior region of the plurality of elongated acoustic bars.

5. The dynamic acoustic system of claim 1, further comprising at least one sound generating device positioned at or near the plurality of elongated acoustic bars and being operably coupled to the controller, wherein the controller further selectively controls operation of the at least one sound generating device.

6. The dynamic acoustic system of claim 1, wherein each of the plurality of movable elements comprises a rotatable louvre, wherein the controller is adapted to transmit a signal that selectively causes a desired number of the plurality of louvres to move.

7. The dynamic acoustic system of claim 6, wherein the plurality of louvres are disposed on at least one of the plurality of side surfaces of the elongated acoustic bar.

8. A dynamic acoustic accessory for use in connection with an indoor environment, the dynamic acoustic system comprising:

an elongated shell including an upper portion, a lower portion, a plurality of side surfaces extending between the upper portion and the lower portion, and an interior region at least partially defined by the upper portion, the lower portion, and the plurality of side surfaces;

at least one mounting structure operably coupled to the elongated shell, the at least one mounting structure adapted to secure the elongated shell to a ceiling surface of the indoor environment; and a movable base member positioned at the lower portion of the elongated shell, the movable base member comprising a generally planar elongated platform having at least one sidewall extending therefrom, the elongated platform and the at least one sidewall defining a volume and a drive mechanism coupled with the elongated platform, the drive mechanism adapted to move the movable base member between a first, raised position and a second, lowered position that is away from the lower portion of the elongated shell to selectively expose at least a portion of the interior region of the elongated shell and the volume of the elongated platform to the indoor environment to alter an acoustic characteristic of the indoor environment.

9. The dynamic acoustic accessory of claim 8, further comprising a sound absorbing material at least partially disposed within the interior region of the elongated shell.

10. The dynamic acoustic accessory of claim 8, further comprising at least one sound generating device positioned at or near the upper portion of the elongated shell.

11. The dynamic acoustic accessory of claim 8, wherein the at least one mounting structure comprises at least one of a chain, an elongated rod, a fastener, or an adhesive.

12. A dynamic acoustic accessory for use in connection with an indoor environment, the dynamic acoustic accessory comprising:

an elongated shell including an upper portion, a lower portion, a plurality of side surfaces extending between the upper portion and the lower portion, and an interior region at least partially defined by the upper portion, the lower portion, and the plurality of side surfaces;

at least one mounting structure operably coupled to the elongated shell, the at least one mounting structure adapted to secure the elongated shell to a ceiling surface of the indoor environment; and a plurality of movable louvres coupled to at least one of the plurality of side surfaces of the shell, each of the plurality of movable louvres being selectively movable between a first position and a second position to selectively expose at least a portion of the interior region of the elongated shell to the indoor environment to alter an acoustic characteristic of the indoor environment.

13. The dynamic acoustic accessory of claim 12, wherein at least one of the plurality of movable louvres is individually actuable via a drive mechanism coupled thereto, the drive mechanism configured to selectively rotate the at least one movable louvre relative to the elongated shell.

14. The dynamic acoustic accessory of claim 12, further comprising a sound absorbing material at least partially disposed within the interior region of the elongated shell.

15. The dynamic acoustic accessory of claim 12, further comprising at least one sound generating device positioned at or near the upper portion of the elongated shell.

16. The dynamic acoustic accessory of claim 12, wherein the at least one mounting structure comprises at least one of a chain, an elongated rod, a fastener, or an adhesive.

* * * * *